United States Patent [19]

Allen et al.

[11] Patent Number: 4,459,012

[45] Date of Patent: Jul. 10, 1984

[54] CLEANING STATION AIR DIVERTERS

[75] Inventors: James D. Allen; Ernest J. Tamary, both of Rochester; Paul E. Tschiderer, Geneseo, all of N.Y.

[73] Assignee: Eastman Kodak Company, Rochester, N.Y.

[21] Appl. No.: 365,843

[22] Filed: Apr. 5, 1982

[51] Int. Cl.[3] ..... G03G 21/00

[52] U.S. Cl. ..... 355/15; 15/256.52

[58] Field of Search ..... 355/3 R, 15; 15/256.51, 15/256.52

[56] References Cited

U.S. PATENT DOCUMENTS

| | | | |
|---|---|---|---|
| 3,217,646 | 11/1965 | Sharkey . | |
| 4,026,701 | 5/1977 | Till et al. . | |
| 4,113,376 | 9/1978 | Rodda | 355/15 |
| 4,205,911 | 6/1980 | Dole | 355/15 |

OTHER PUBLICATIONS

Industrial Ventilation, American Conference of Governmental Industrial Hygienists (1980), pp. 4–16 and 4–17.

*Primary Examiner*—Fred L. Braun

*Attorney, Agent, or Firm*—Norman Rushefsky

[57] ABSTRACT

In a rotating cleaning brush apparatus of an electrographic copier having a housing defining a chamber which partially encloses the cleaning brush, a plurality of airflow dividers are disposed within the chamber. These dividers form channels extending from a position adjacent to the rotating brush into an outlet port of the chamber. The outlet port is coupled to a source of vacuum. Airflow is established across the length of the brush and entrains toner and carries it into the channels at sufficient velocity to transport toner from the chamber.

3 Claims, 5 Drawing Figures

PRIOR ART

CLEANING STATION AIR DIVERTERS

FIELD OF THE INVENTION

This invention relates to cleaning apparatus for removing toner from photoconductive members of copiers.

BACKGROUND OF THE INVENTION

Description of the Prior Art

Modern high-speed electrographic copiers make document reproductions by exposing an electrically-charged photoconductive member to a light image of the document. The light image selectively discharges the photoconductive member to form a latent image charge pattern on the member corresponding to the document. An oppositely charged developer material is brought into contact with the latent image to develop the image. The developed image is then transferred to a receiver sheet and fixed to the sheet by heat and/or pressure to yield the desired copy.

The developer material includes a resinous powder known as toner. If all the toner is not transferred to the receiver sheet, the residual toner may scatter throughout the copier and contaminate other components within the copier. It is therefore standard practice to include apparatus for cleaning the photoconductive member immediately after image transfer from the photoconductive member to the receiver sheet.

Typical cleaning apparatus for a photoconductive member are shown and described in U.S. Pat. Nos. 3,615,813; 3,838,922 and 4,099,861. Briefly, one of the most commonly used cleaning apparatus includes a rotating bristle brush which sweeps residual toner from a photoconductive member. This brush is mounted in a manifold housing defining a chamber having an outlet port. The chamber encloses the rotating brush except for an opening adjacent to the photoconductive member through which the brush extends for contacting the photoconductive member. A source of vacuum connected to the outlet port establishes an airflow which transports toner from the brush and chamber where it is subsequently removed by filter apparatus.

In practice, toner often times is not completely removed from the chamber of the cleaning apparatus due to uneven airflow over the length of the brush and within the chamber. This uneven airflow causes nonuniform cleaning of the rotating brush and results in deposition of the toner in areas of the chamber where the airflow velocity becomes too low to transport toner. Eventually, airflow and cleaning efficiency can be reduced to a point where residual toner material is left on the photoconductive member and is transferred to subsequent receiver sheets resulting in copies with ghost images or high density background.

SUMMARY OF THE INVENTION

In accordance with the present invention, there is provided an improved cleaning apparatus having a manifold housing which partially encloses a rotating brush. The manifold housing defines a chamber. A plurality of airflow dividers are disposed within the chamber forming channels extending from a position spaced near the brush into an outlet port which is coupled to a source of vacuum. These channels uniformly direct airflow across the length of the brush to remove toner therefrom. Such removed toner is entrained in the airflow and carried at sufficient velocity through the channels to transport substantially all of the removed toner from the chamber.

BRIEF DESCRIPTION OF THE DRAWINGS

In the detailed description of the preferred embodiment of the invention presented below, reference is made to the accompanying drawings in which:

Referring now to the drawings, FIG. 1 shows a conventional electrographic copier 8 having a flexible transparent photoconductive member 10 supported on rollers **12*a* through 12*e* for movement about a closed loop path in the direction of arrows 14. In an electrographic cycle, the photoconductive member 10 is electrically charged by a primary charger (not shown) just before the member 10 passes through an exposure station 18. In the exposure station 18, a light image of the document to be copied is exposed on the member 10 to selectively discharge the member in an image wise configuration producing a latent image of the document on the member 10. In a developer station 20, the latent image is developed by bringing toner into contact with the charged member 10. The developed image is transferred to a receiver sheet (not shown) in a transfer station 22. The transfer station 22 applies a charge to the sheet to attract the developed image from the member 10 onto the sheet. A cleaning apparatus 24 removes residual toner from member 10. Residual toner is that which failed to transfer in the transfer station 22 from the member 10** to the receiver sheet.

A representative cleaning apparatus 24 as known in the art is shown in FIGS. 2 and 2A. It includes a manifold housing 27 having walls 29 defining a chamber 26 within which a cleaning brush 28 is rapidly rotated by a motor (not shown) for the purpose of sweeping residual toner from the photoconductive member 10 at its point of contact therewith. Cylindrical portions of the walls 29 extend in close proximity to the brush 28 over a substantial portion of the brush length and circumference. The walls 29 form an opening adjacent to the photoconductive member 10 through which the brush 28 extends and contacts the member 10. As best shown in the lower right hand portion of FIG. 2, the walls 29 form an outlet port 33. As shown in FIG. 1, a vacuum source 50 with a filter apparatus 52 is coupled by a flexible tube 53 to the outlet port 33. The vacuum source, shown as a blower 50, establishes an airflow (indicated by arrows 34). The filter 52 positioned between the outlet port 33 and the vacuum source 50 removes toner from the resultant airflow 34. Air flows into the chamber 26 from outside the manifold housing 27 through a space 25 (see FIG. 2A) between the rotating brush 28 and the walls 29.

Figure 1:
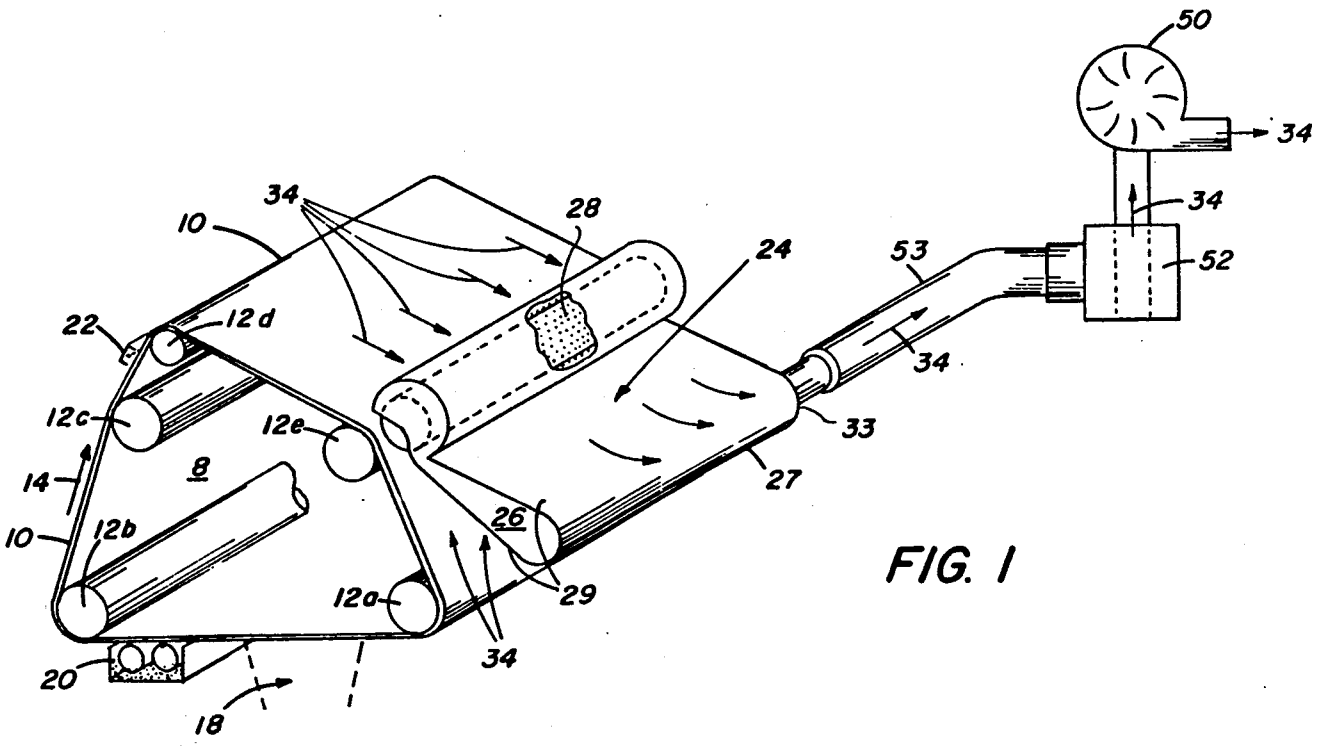
FIG. 1 is a perspective of a conventional electrographic copier showing various processing stations including cleaning apparatus.

The rotating brush 28 contacts and sweeps the photoconductive member 10 to remove residual toner. Airflow (shown by arrows 34) about the brush entrains toner and transports it from the brush 28 and the chamber 26. The velocity of the airflow 34 is higher adjacent to wall 29A of the chamber 26 than it is adjacent to the opposite wall 29B. See FIG. 2. The reason for this is that the distance along wall 29A between space 25 and the outlet port 33 is shorter than the comparable distance along wall 29B. This results in nonuniform airflow velocity. If the airflow velocity becomes too low, toner precipitates to form deposits 36 on the wall within the chamber. These precipitated toner deposits 36 provide obstructions to airflow and further reduce the airflow velocity causing more toner to precipitate out of the airflow. As this process continues, a point in time may be reached where the airflow about some portions of the brush 28 is so reduced that toner is no longer removed from the brush 28. The brush 28 will not properly clean the member 10 and residual toner remains on the photoconductive member 10. Subsequent transfer of this residual toner to copy sheets causes ghost images or increased background density. As so far described, the manifold housing 27 is well known in the art.

Figure 2:
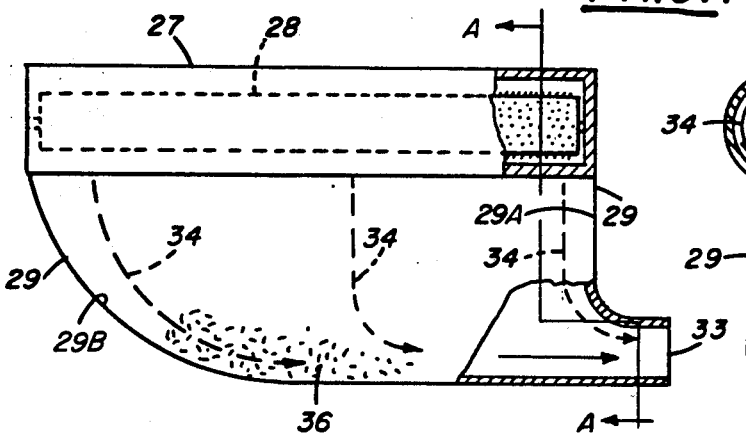
FIG. 2 is an elevational view of a conventional manifold housing.
Figure 2A:
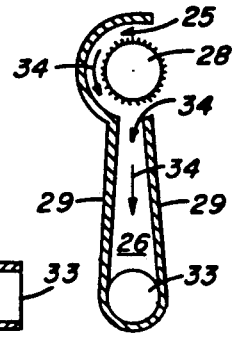
FIG. 2A is a sectional view taken along lines A—A of FIG. 2.
Figure 3:
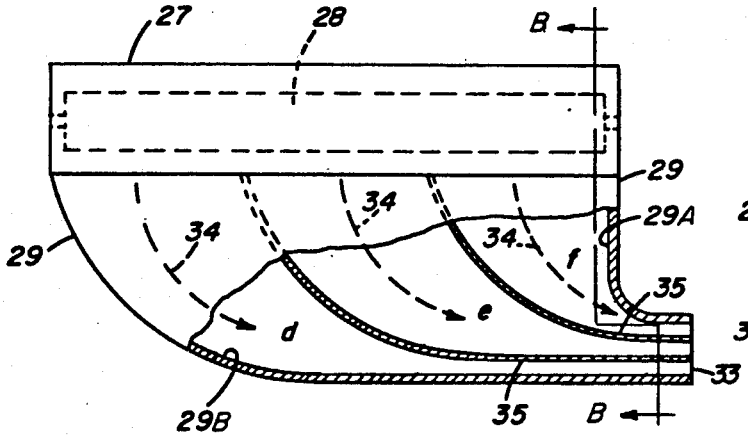
FIG. 3 is an elevational view of a cleaning manifold housing incorporating airflow dividers according to this invention.
Figure 3A:
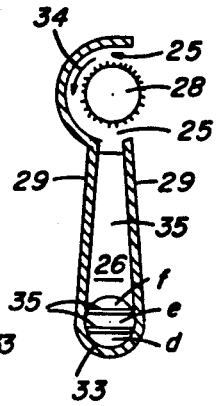
FIG. 3A is a sectional view taken along lines B—B of FIG. 3.

Turning now to FIGS. 3 and 3A, there is shown the manifold housing 27 in accordance with the invention. The housing 27 is the same as shown in FIGS. 2 and 2A with the addition of airflow dividers 35. The airflow dividers 35 extend from a position adjacent to the cleaning brush 28 into the outlet port 33. The airflow dividers 35 are fixed to walls 29 of the manifold housing 27 and form channels d, e and f within the chamber 26. Each channel establishes airflow about a portion of the length of the brush 28. The airflow velocity can be adjusted by varying the length of each divider 35 and the spacing between them. It has been found to be desirable that the airflow velocity be relatively uniform across the entire length of the cleaning brush 28. The length of each divider 35 and the spacing between them can be determined experimentally to achieve this uniformity. The velocity of airflow within the channels of the chamber must be high enough for adequate removal of toner. This velocity can be adjusted by changing the outlet port pressure.

The provision of airflow dividers within a manifold housing of a cleaning apparatus of an electrographic copier significantly improves airflow uniformity for cleaning the rotating brush and minimizes precipitation of toner within the manifold housing chamber.

The invention has been described in detail with particular reference to a preferred embodiment thereof, but it will be understood that variations and modifications can be effected within the spirit and scope of the invention.

I claim:

1. In an electrographic copier with a cleaning apparatus having a rotating brush which sweeps toner from a photoconductive member, a manifold housing defining a chamber for receiving said brush and having an opening through which said brush extends in contact with such member, said housing having an outlet port adapted to be connected to a source of vacuum for establishing an airflow about said brush and through said chamber, the improvement comprising:

a plurality of dividers in said chamber forming a plurality of separate airflow channels which extend between a position adjacent to said brush and said outlet port for establishing airflow uniformity about and across the length of said brush to entrain toner and transport the entrained toner through said outlet port.

2. In an electrographic copier with a cleaning apparatus for removing residual material from a photoconductor, the apparatus comprising:

a rotary cleaning means for removing residual material from a surface;

a housing including vacuum providing means for establishing an air flow about the cleaning means for removing airborne particles from the vicinity of the cleaning means; and collecting means for collecting the particles so removed; the housing including a manifold chamber including walls for defining a flow path for airborne particles from the cleaning means to the collecting means, the manifold chamber including an inlet comprising a narrow neck, extending at least for the full width of the cleaning means and providing a relatively high speed of air flow into the manifold chamber, the walls of the manifold chamber diverging away from the neck and providing a relatively lower speed of air flow in the chamber as the air, moving in a first direction, becomes further removed from the neck, a wall of the manifold chamber including an outlet port and causing the air flow to change its direction of flow and assume a flow in a second direction in order for air, with the airborne particles, to exit from the manifold chamber; and the improvement which comprises a plurality of air flow dividing walls in the manifold chamber extending between the outlet port and the neck, the ends of the dividing walls adjacent the neck being located near intermediate portions of the brush, the dividing walls being each shaped to gradually turn the general direction of air flow from said first direction towards the second direction and the dividing walls providing a plurality of separate air flow paths between the neck and the outlet port to transport the airborne particles through the outlet port.

3. In an electrographic copier with a cleaning apparatus for removing residual material from a surface, the apparatus comprising:

a rotary generally cylindrical brush for removing the residual material from the surface;

a housing including vacuum providing means for establishing an air flow about the brush for removing airborne particles from the vicinity of the brush; and collecting means for collecting the particles so removed, the housing including:

(a) a hood-like chamber surrounding the brush and providing an opening to permit engagement of the brush with the surface, and (b) a manifold chamber including walls for defining a flow path for airborne particles from the brush to the collecting means, the manifold chamber including an inlet comprising a narrow neck, extending at least for the full width of the brush and providing a relatively high speed of air flow into the manifold chamber, the walls of the manifold chamber diverging away from the neck and providing a relatively lower speed of air flow in the chamber as the air, moving in a first direction, becomes further removed from the neck, a wall of the manifold chamber including an outlet port and causing the air flow to change its direction of flow and assume a flow in a second direction generally parallel to the axis of the brush in order for air, with the airborne particles, to exit from the manifold chamber; and the improvement which comprises a plurality of air flow dividing walls in the manifold chamber extending between the outlet port and the neck, the ends of the dividing walls adjacent the neck being located near intermediate portions of the brush, the dividing walls being each shaped to gradually turn the general direction of air flow from said first direction towards the second direction and the dividing walls providing a plurality of separate air flow paths between the neck and the outlet port to transport the airborne particles through the outlet port.

* * * * *